United States Patent [19]

Kröner

[11] Patent Number: 4,970,709

[45] Date of Patent: Nov. 13, 1990

[54] WATCH HAND ADJUSTMENT GEAR

[75] Inventor: Wolfgang Kröner, Pforzheim, Fed. Rep. of Germany

[73] Assignee: Pforzheimer Uhrenrohwerke Porta GmbH, Pforzheim, Fed. Rep. of Germany

[21] Appl. No.: 878,343

[22] Filed: Jun. 25, 1986

[30] Foreign Application Priority Data

Jun. 25, 1985 [DE] Fed. Rep. of Germany ..... 3522672

[51] Int. Cl.[5] ..... G04B 27/00

[52] U.S. Cl. ..... 368/308; 368/319; 368/190; 368/185; 368/196

[58] Field of Search ..... 368/185, 191–195, 368/206, 319, 199, 308

[56] References Cited

U.S. PATENT DOCUMENTS

| | | | |
|---|---|---|---|
| 1,848,562 | 3/1932 | Greenleaf | 368/185 |
| 4,262,354 | 4/1981 | Sakamoto | 368/185 |
| 4,295,215 | 10/1981 | Kitai et al. | 368/185 |

*Primary Examiner*—Bernard Roskuski

[57] ABSTRACT

A hand adjustment structure for a wristwatch which has a spur gear structure disposed intermediate the minute and the hour gears of the watch includes a crown gear structure on one side of the spur gear disc for engagement with the pinion of a time setting shaft by which the spur gear structure can be rotated and together therewith the watch's minute and hour hands radial projections are stamped axially out of the spur gear disc in a circular array so as to form the crown gear structure integrally with the spur gear disc.

5 Claims, 2 Drawing Sheets

WATCH HAND ADJUSTMENT GEAR

BACKGROUND OF THE INVENTION

The invention relates to a hand adjusting arrangement for a watch, especially a wristwatch, particularly the adjusting gear for adjusting the watch hands.

As adjusting gear in a watch operating mechanism the spur gear structure arranged between the minute gear and the hour gear is usually utilized and the spur gear disc is provided for this purpose with a crown gear structure which may be engaged by a gear disposed on the hand adjustment shaft for setting the watch's time.

Such spur gears with crown gear structures are relatively difficult to manufacture since they require machining operations in two different planes and, furthermore the crown gear structure must be machined by special machinery which differs from the equipment utilized for the manufacture of the spur gears.

In order to somewhat facilitate the manufacture of such gear structures it was already proposed to simply manufacture the spur gears without crown gear structures thereon and to manufacture a crown gear separately and then mount the crown gear onto the spur gear. Such an arrangement however increases the thickness of the operating mechanism and therefore, while such solution may be quite adequate for clocks or larger watches, it is not a desirable solution for today's small wristwatches whose operating mechanisms must be small and especially slim so that the use of an additional crown gear mounted on a spur gear is out of question.

It is the object of the present invention to provide spur gears as they are used in watches as intermediate gears between the minute and the hour hand drives with a crown gear structure which will not increase the thickness of the gears and which furthermore is easy and inexpensive to manufacture.

SUMMARY OF THE INVENTION

A hand adjustment structure for a wristwatch wherein a spur gear structure is disposed intermediate the minute and hour gears of the watch and a crown gear structure is disposed on the side of the disc-shaped spur gear structure so as to be engageable by the pinion of a time setting shaft by which the spur gear structure and the associated minute and hour hands can be moved, the crown gear structure consisting of radially extending projections stamped axially out of the spur gear disc in an annular array thereby forming the crown gear structure integrally with the spur gear disc.

With this arrangement the crown gear structure is no longer cut from a full material structure by cutting, grinding or slotting, but projections are stamped out of the spur gear wall so that they project axially therefrom in a circular array. During the stamping process the projections may at the same time be shaped to assume side edges in the form of the teeth of gears in order to provide for easy operation of the adjustment mechanism by the operating pinion on the time setting shaft. Since the operating pinion on the time setting shaft is normally disposed within the circular array of the crown gears and is pulled outwardly in engagement with the crown gears only for the purpose of setting the time, it is advantageous if the projections are so formed that they remain firmly attached to the operating gear body at their radially inner ends and project at their radially outer ends since such an arrangement will facilitate the engagement procedure. The crown gear structure may also be formed by sections which are stamped out in such a manner that they are connected to the operating spur gear disc at both the radial inner and outer ends such that they can be easily engaged by the setting shaft pinion from both ends.

In any case, the watch operating spur gear, when designed in accordance with the present invention and having a crown gear structure formed directly from the spur gear disc walls, provides for easy and very economic manufacture especially since the time setting mechanism is rarely used with today's accurate watches.

SHORT DESCRIPTION OF THE DRAWINGS

DESCRIPTION OF A PREFERRED EMBODIMENT

Figure 1:
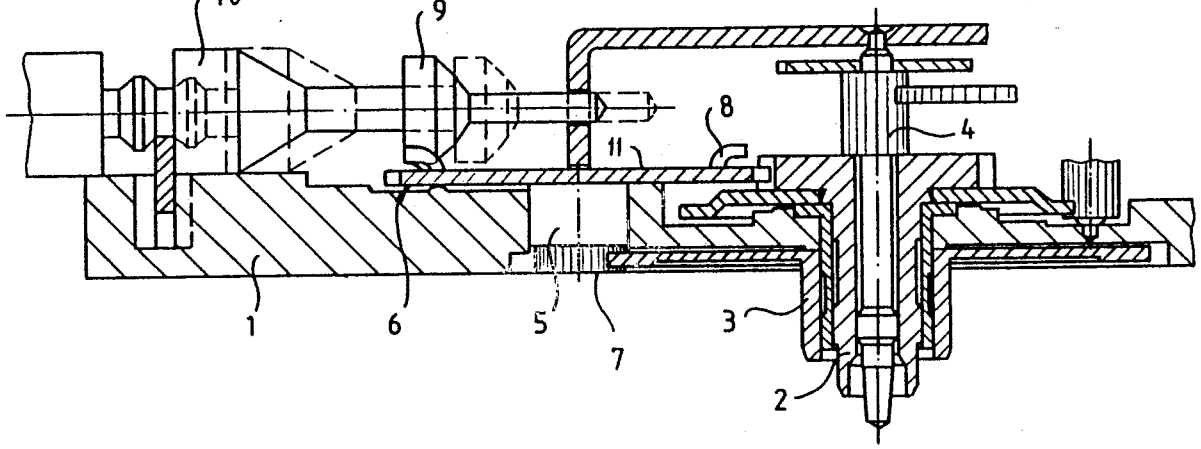
FIG. 1 shows schematically a portion of a wristwatch operating mechanism and the time setting arrangement therefor.
Figure 2:
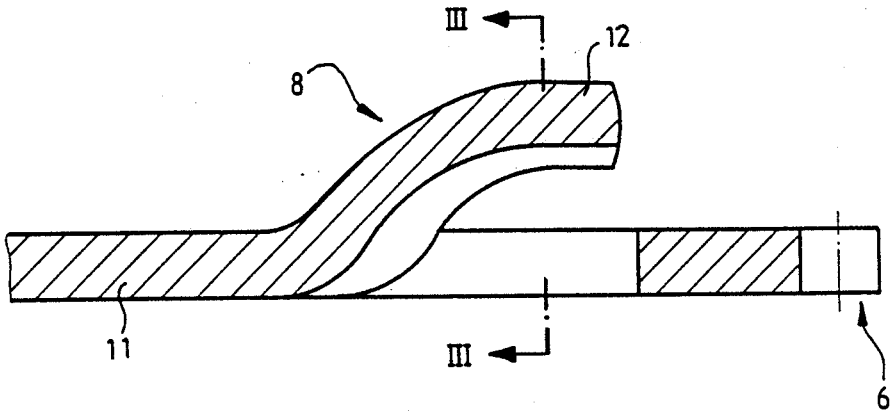
FIG. 2 shows a section of the spur gear carrying the crown gear structure, the section being taken along line II—II of FIG. 3.

As shown in FIG. 1 the mounting plate 1 of a watch has rotatably supported thereon a minute gear structure 2 and, concentric with the minute gear structure 2, an hour gear structure 3. Concentrically disposed within the minute gear structure 2 is the shaft structure 4 carrying the seconds indicating hand. Also supported on the mounting plate 1 is a speed reducing spur gear structure 5 which is in engagement with the minute gear 2 and the hour gear 3. The spur gear structure 5 carries, in addition to the gearing 6, 7, a crown gear structure 8 which is engageable by a gear 9 disposed on a time setting shaft 10 which is axially movable to permit engagement of the crown gear structure 8 by the gear 9 and rotation of the spur gear structure 5 when a change in the time as indicated by the watch's hands is desired. FIG. 1 indicates the position of the time setting shaft 10 and the gear 9 thereon in dashed lines when disengaged from the crown gear structure 8. Whenever a change of the time setting of the watch is desired, the time setting shaft 10 is moved axially from the position as shown in dashed lines to the position as shown in full lines in which the gear 9 is in engagement with the crown gear structure 8 of the spur gear structure 5. After adjustment of the time by rotation of the shaft 10, the shaft 10 and the pinion gear 9 are returned to the position as shown in dashed lines.

Figure 3:
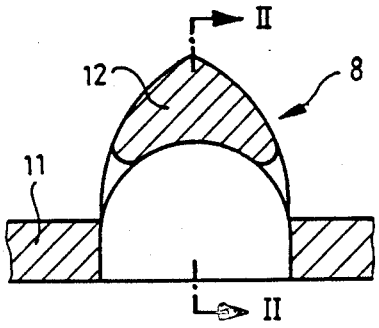
FIG. 3 is a sectional view along line III—III of FIG. 2.

The crown gear structure 8 of the large gear 11 of the spur gear structure 5 is formed by projections 12 stamped out of the side of the gear disc 11 in a circular array. As shown in the Figures the projections 12 are formed by bending a small radial section of the disc 11 out of the plane of the gear disc such that they remain connected to the disc 11 at one end, preferably, and as shown in the Figures at their radial inner ends. The projections are suitably formed by punching or stamping into a die such that the projections 12 are not only generated out of the disc material but that they are at the same time properly shaped so as to have the gear-tooth shape as shown in cross-section in FIG. 3. In this manner, the gear disc 11, that is, the spur gear structure 5, can be manufactured very economically and also the crown gear structure 8 is in such a shape that easy and good engagement thereof by the pinion is assured.

What is claimed is:

1. A hand adjusting arrangement for a watch, especially a wristwatch, comprising a spur gear structure disposed intermediate, and in engagement with, the minute gear and the hour gear of the watch for transmitting motion from one to the other, a crown gear structure disposed on one side of said spur gear structure, a time setting shaft disposed adjacent said spur gear structure and carrying a pinion adapted to engage said crown gear structure for rotating the spur gear structure and thereby changing the position of the watch's hands associated with the spur gear structure, said crown gear structure having radially extending projections stamped axially out of the walls of said spur gear structure in a circular array so as to form said crown gear structure.

2. An arrangement according to claim 1, wherein said projections are narrow radial sections cut from and bent out of the plane of said spur gear structure such that they remain connected with said spur gear at the radially inner ends thereof.

3. An arrangement according to claim 1, wherein said projections are gear-tooth shaped in cross-section.

4. An arrangement according to claim 3, wherein said projections are formed by die-stamping thereby to provide for said gear-tooth shaped sections.

5. An arrangement according to claim 3, wherein said gear-tooth shaped projections are formed by punching.

* * * * *